US005185077A

United States Patent [19]

Owen

[11] Patent Number: 5,185,077

[45] Date of Patent: Feb. 9, 1993

[54] TRANSFER LINE QUENCHING WITH CYCLONE SEPARATION

[75] Inventor: Hartley Owen, Belle Mead, N.J.

[73] Assignee: Mobil Oil Corporation, Fairfax, Va.

[21] Appl. No.: 674,242

[22] Filed: Mar. 25, 1991

[51] Int. Cl.[5] ..... C10G 65/12; C10G 91/16; C10G 57/00

[52] U.S. Cl. ..... 208/61; 208/48 Q; 208/67; 208/113

[58] Field of Search ..... 208/48 Q, 61, 67, 113

[56] References Cited

U.S. PATENT DOCUMENTS

| | | | |
|---|---|---|---|
| 2,901,418 | 8/1959 | Pappas | 208/48 Q |
| 3,338,821 | 8/1967 | Moyer et al. | 208/48 Q |
| 3,676,519 | 7/1972 | Dorn et al. | 208/48 Q |
| 4,043,899 | 8/1977 | Anderson et al. | 208/113 |
| 4,049,540 | 9/1977 | Ueda et al. | 208/40 Q |
| 4,351,275 | 9/1982 | Bhojwani et al. | 122/7 R |
| 4,822,761 | 4/1989 | Walters et al. | 208/113 |
| 4,980,052 | 12/1990 | Green et al. | 208/120 |
| 5,019,239 | 5/1991 | Owen | 208/48 Q |
| 5,043,058 | 8/1991 | Forgac et al. | 208/48 |
| 5,073,249 | 12/1991 | Owen | 208/48 Q |

*Primary Examiner*—Theodore Morris
*Assistant Examiner*—P. L. Hailey
*Attorney, Agent, or Firm*—Alexander J. McKillop; Malcolm D. Keen; Richard D. Stone

[57] ABSTRACT

A process and apparatus for fluidized catalytic cracking of heavy oils are disclosed. Quenching and cyclone separation are done in the transfer line to the main distillation column. Quenching hot vapor from the reactor, preferably with liquid recycled from the main column, improves yields, prevents coking in the transfer line and permits higher cracking reactor temperatures. Cyclone separation of quench and/or condensed liquid prevents slugging, or two phase flow, in the transfer line. Some rough-cut fractionation can be achieved in the cyclone separator. Steam stripping of cyclone liquid optimizes operation of the main column.

19 Claims, 2 Drawing Sheets

TRANSFER LINE QUENCHING WITH CYCLONE SEPARATION

BACKGROUND OF THE INVENTION

1. Field of the Invention

The field of the invention is catalytic cracking of heavy hydrocarbon oils to lighter products in general, and reducing unfavorable thermal reactions in a transfer line connecting the reactor to a fractionator, in particular.

2. Description of Related Art

Catalytic cracking is the backbone of many refineries. It converts heavy feeds into lighter products by catalytically cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular and efficient fluidized bed process.

In moving bed cracking, the catalyst is in bead form. Feed contacts a moving bed of bead catalyst and is cracked into lighter products. The lighter products are removed from the reactor and charged via a transfer line to a distillation column, sometimes called the synthetic crude tower (Syntower) or the main column. In some moving bed units, the reactor effluent vapors were cooled in the transfer line just upstream of the main column, by injection of a recycle stream from the main column. The reactor effluent was cooled so that no superheated vapor would enter the column. Enough liquid was introduced into the transfer line just upstream of the main column to cool the effluent and produce a two phase mixture, which was charged to the base of the main column. Usually the liquid was injected by a single spray nozzle, which moved a lot of liquid into the transfer line, but did only a fair job of contacting the liquid spray with the hot vapor.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425 C.-600 C., usually 460 C.-560 C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500 C.-900 C., usually 600 C.-750 C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone progressive development since the 40s. The trend of development of the fluid catalytic cracking (FCC) process has been to all riser cracking and use of zeolite catalysts.

Zeolite-containing catalysts having high activity and selectivity are now used in most FCC units. These catalysts work best when coke on the catalyst after regeneration is less e.g., less than 0.3 wt.

To regenerate FCC catalysts to these low residual carbon levels, and to burn CO completely to CO2 within the regenerator (to conserve heat and minimize air pollution) many FCC operators add a CO combustion promoter metal to the catalyst or to the regenerator.

U.S. Pat. Nos. 4,072,600 and 4,093,535, which are incorporated by reference, teach use of combustion-promoting metals such as Pt, Pd, Ir, Rh, Os, Ru and Re in cracking catalysts in concentrations of 0.01 to 50 ppm, based on total catalyst inventory. Modern, zeolite based catalyst are so active that the heavy hydrocarbon feed can be cracked to lighter, more valuable products in much less time. Instead of dense bed cracking, with a hydrocarbon residence time of 20-60 seconds, much less contact time is needed. The desired conversion of feed can now be achieved in much less time, and more selectively, in a dilute phase, riser reactor.

Riser cracking is more selective than dense bed cracking. Refiners maximized riser cracking benefits, but in so doing induced, inadvertently, a significant amount of thermal cracking. Thermal cracking is not as selective as either riser cracking or dense bed cracking, and most refiners would deny doing any thermal cracking, while building and operating FCC units with all riser cracking which also did a significant amount of thermal cracking.

Thermal cracking was a by-product of upflow riser reactors, which discharged cracked products more than 100 feet up, and product fractionators which charged the hot vapors from the FCC unit to the bottom of the main column. The transfer lines to connect the FCC kept getting longer, and the material exiting the riser reactor kept getting hotter, and the combination caused thermal cracking. The trend to heavier feeds only made things worse. Higher temperatures were sought to crack the heavy feed, but the heavy feeds contained more highly aromatic material that wanted to thermally degrade to coke or other undesired species.

The reasons for high risers in FCC, and for adding hot vapor to the bottom of the FCC main column will be briefly reviewed. After this, some other work on minimizing thermal cracking in riser cracking FCC units will be reviewed.

Risers are tall because of high vapor velocities and residence time. The FCC riser operates in dilute phase flow. There is better distribution of catalyst across the riser when vapor velocities are fairly high. Many FCC riser reactors now operate with vapor velocities on the order of 20-50 feet per second. To achieve enough residence time in the riser, the riser must be very tall. For a 2 second hydrocarbon residence time, the riser must be at least 100 feet long with a 50 fps vapor velocity. There usually must be addition space provided at the base of the riser reactor to add catalyst and more space for feed nozzles. The cracked vapor products exit the riser and enter a reactor vessel, at an elevation more than 100 feet in the air, for separation of spent catalyst from cracked products, usually in one or more stages of cyclone separation. The cracked products are eventually discharged, usually up, from the separation section, usually at an elevation well above the top of the riser, and charged to the base of the main column.

Hot vapors from the FCC unit are charged to the base of the main column for several reasons, but primarily so that the hot vapors may be used to heat the column. Another reason is that the hot vapors always contain some catalyst and catalyst fines, which are never completely removed in the FCC reactor, despite the use of multiple stages of cyclone separators. Adding the fines laden vapor to the bottom of the main column at least minimizes amount of fines that must circulate through the column. The fines are largely confined to the very base of the column. The lower trays or packing of the main column are designed to tolerate the fines by using sloping trays that permit fines to drain or be swept from a tray without clogging it.

The combination of high temperatures in the riser reactor, a tall riser reactor, and a bottom fed main column, give enough residence time to cause significant thermal cracking to occur. Such modern reactor designs, and better catalyst, allowed refiners to use the process to upgrade poorer quality feedstocks, in particular, feedstocks that were heavier or contained resid.

Processing resids exacerbated existing problem areas in the riser reactor, namely feed vaporization, catalyst oil contact, accommodation of large molar volumes in the riser, and coking in the transfer line from the reactor to the main fractionator. Each of these problem areas will be briefly discussed.

Feed vaporization is a severe problem with heavy feeds such as resids. The heavy feeds are viscous and difficult to preheat in conventional preheaters. Most of the heating and vaporization of these feeds occurs in the base of the riser reactor, where feed contacts hot, regenerated catalyst. Because of the high boiling point, and high viscosity, of heavy feed, feed vaporization takes longer in the riser, and much of the riser length is wasted in simply vaporizing feed. Multiple feed nozzles, fog forming nozzles, etc., all help some, but most refiners simply add more atomizing steam. Use of large amounts of atomizing steam helps produce smaller sized feed droplets in the riser, and these smaller sized drops are more readily vaporized. With some resids, operation with 3-5 wt % steam, or even more, approaching in some instances 5-10 wt % of the resid feed, is needed to get adequate atomization of resid. All this steam helps vaporize the feed, but wastes energy because the steam is heated and later condensed. It also adds a lot of moles of material to the riser. The volume of steam approaches that of the volume of the vaporized resid in the base of the riser. This means that up to half of the riser volume is devoted to steaming (and deactivating) the catalyst, rather than cracking the feed.

In many FCC units better feed vaporization is achieved by using a higher temperature in the base of the riser reactor, and quenching the middle of the riser or the riser outlet.

Catalyst/oil contact is concerned with how efficiently the vaporized feed contacts catalyst in the riser. If feed vaporization and initial contacting of catalyst and oil is efficient, then catalyst/oil contact will tend to be efficient in the rest of the riser as well. High vapor velocities, and more turbulent flow, promote better contact of catalyst and oil in the riser. High superficial vapor velocities in the riser mean that longer risers are required to achieve the residence time needed to attain a given conversion of heavy feed to lighter components.

Large molar volumes are sometimes a problem when processing resids. At first glance resids should be easy to handle, because with an extremely high molecular weight, resids occupy little volume when vaporized. Resids, and lighter feeds, rapidly crack to produce a large molar expansion. To vaporize resids, large amounts of vaporization steam are added, which adds to the volume of material that must be processed in the riser. Higher temperatures in the riser make quenching beneficial, and addition of quench material to the riser, or to the riser outlet, further increase the volume of material that must be handled by the main column. More volume does not usually translate into reduced residence time in the transfer line connecting the cracked vapor outlet near the top of the FCC riser to the base of the main column. This is because refiners usually limit the vapor velocity in large vapor lines to about 120 to about 150 feet per second. Vapor velocities below this are used for several reasons, but primarily to control erosion and limit pressure drop. Erosion is a problem because of the presence of catalyst fines. Pressure drop is a problem, because it takes a lot of energy to transfer large volumes of material through a large pressure drop. High pressure drops in this transfer line, the line to the main column, would also increase the FCC reactor pressure, which is undesirable from a yield standpoint, and decrease the main column pressure which increases the load on the wet gas compressor associated with the main column.

With worse feeds, and higher temperatures in the reactor, coking in the transfer line connecting the FCC reactor vapor outlet with the main column is now a problem.

FCC operators have long known that "dead spaces" in a line could lead to coke formation. Coke formation is a frequently encountered problem in the "dome" or large weldcap which forms the top of the vessel housing the riser reactor cyclones. If oil at high temperature is allowed to remain stagnant for a long time, it will slowly form coke. For this reason refiners have routinely added a small amount of "dome steam", typically 500 #/hr, to prevent formation of coke in the dome of an FCC unit. Coking in the transfer line is somewhat related, in that coke will form in stagnant or dead areas of the transfer line. Coke will also form if there are cool spots in the transfer line. The cool spots allow some of the heaviest material in the reactor effluent vapor to condense. These heavy materials, some of which may be entrained asphaltenic materials, will form coke if allowed to remain for a long time in the transfer line. Thus refiners have tried to insulate the transfer line to the main column, not only to prevent heat loss to the atmosphere, but also to prevent coking in this line. The problem of coke formation gets more severe with either an increase in reactor/transfer line temperatures, or with a decrease in feed quality so that it contains more heavier materials.

Although great strides have been made in many parts of the FCC process, such as better regenerators, better catalyst strippers, and better catalysts, the process has not been able to realize its full potential, especially with heavy feedstocks including non-distillable materials.

High temperatures, high riser vapor velocity, and tall risers all improve the cracking process and provide better yields of cracked products. These allow FCC units to process worse feeds. These trends also caused unselective thermal cracking of the valuable cracked products, and increased the amount of energy needed to move cracked products from the reactor to the main column.

Most refiners ignored the problem. One refiner's attempt to solve a different problem (which no longer exists—excessive catalyst fines in cracked product causing line erosion) would inherently reduce transfer line coking, but create other problems. Thus U.S. Pat. No. 3,338,821 taught injection of sufficient quench liquid into a transfer line to form a liquid phase. Large amounts of liquid were added, primarily to reduce vapor velocity and to cause erosive catalyst particles to settle out in the liquid phase formed in the transfer line.

The specific problem, erosion in transfer lines caused by high vapor velocities is not a concern in modern FCC units. Better catalyst, with reduced attrition rates and better cyclone separators, especially those closely coupled to riser reactors having large vapor velocity heads available to improve cyclone efficiency, have greatly reduced the amount of fines carried over into transfer lines. So far as is known, no refiners practice such injection of liquid into transfer lines Part of the reason may be the reluctance of refiners to permit two phase flow in such transfer lines. The problems of slugging, higher pressure drop, and too much weight from potentially liquid full lines would deter most refiners from practicing this invention.

The injection method proposed in '821 may also coke the transfer line, especially in modern units processing feeds with large amounts of heavy ends, at high temperatures. The transfer line wall just upstream of the point of quench injection will be very hot, and splashing of liquid on such hot surfaces would probably lead to a rapid coking rates. Catalytic coking can occur on clean metal surfaces. Once coke is formed, it would act as a highly porous sponge for more splashed quench liquid, and may also cause asymptotic coking. The previously deposited coke may act as a macro-radical reacting further with hydrocarbons in the gas phase. These reaction products accumulate and also thermally degrade to form coke.

I wanted to be able to modify existing units to eliminate transfer line coking or transfer line thermal reactions, without completely rebuilding the unit. I needed to cool the reactor effluent vapor enough to quench it but not cool it excessively. I wanted a system that would be reliable, could operate for years, and be fail safe so that something failed the unit could continue to operate, and that would not promote coking.

I believed that the problems of transfer line reactions could be solved using part of the approach disclosed in '821 (quenching with liquid), while avoiding what would seem to be inherent in the practice of that invention. I wanted to avoid the formation of a liquid phase in the transfer line. To me, a liquid phase in the transfer line meant potentially severe operating problems. With ever higher reactor temperatures, and heavier, more thermally reactive feeds, I was concerned that if a liquid film formed anywhere in a transfer line, coking could occur. Upstream of the quench injection point the pipe wall temperature is essentially the same as the reactor outlet temperature. If a liquid phase forms, only the heaviest, and usually most reactive, condensation products will remain where the pipe is hottest, and coke formation is inevitable.

I also wanted to avoid forming a liquid phase downstream of the quench injection point. Two phase flow causes many potential problems, primarily weight and to a lesser extent, vibration and pressure drop. Transfer lines must be exceedingly large in diameter to handle the large vapor volumes generated by modern FCC units, and the piping supports can not support this line if it runs full of liquid. Typical transfer lines are several feet in diameter, and on riser cracking FCC's are typically over 100 ' up. Construction costs of new units would be greatly increased if these lines had to be designed to run liquid full. Many existing refineries could not be economically modified because there is too much other equipment around.

Thus there is a need for a way to reduce thermal cracking in FCC riser reactor transfer lines by quenching, but without loading up the transfer line with liquid. The quenching had to be fast and effective, but quench liquid had to be rapidly and effectively removed from the liquid, and not wet the walls of the transfer line at any point. I discovered a way to quench FCC transfer lines based on existing technology (cyclone separators), which allowed for vigorous quenching, and rapid recovery and removal of quench liquid.

BRIEF SUMMARY OF THE INVENTION

Accordingly, the present invention provides a fluidized catalytic cracking process wherein a heavy hydrocarbon feed comprising hydrocarbons having a boiling point above about 650 F is catalytically cracked to cracked products comprising the steps of catalytically cracking said feed in a catalytic cracking zone operating at catalytic cracking conditions by contacting said feed with a source of hot regenerated cracking catalyst to produce a cracking zone effluent mixture having an effluent temperature and comprising cracked products and spent cracking catalyst containing coke and strippable hydrocarbons; separating said cracking zone effluent mixture into a hot cracked product vapor phase having a temperature above 900 F. and a spent catalyst rich phase; stripping and regenerating said spent catalyst to produce regenerated catalyst which is recycled to crack heavy feed; transferring said hot cracked product vapor from said catalytic cracking zone to a main fractionator transfer line, having an upstream portion which is nearer the cracking reactor and a downstream portion which is nearer the main fractionator, operating at a transfer line temperature above 900 and sufficient to cause at least one of thermal cracking of said cracked vapor and coke formation from said cracked vapor product in said transfer line; quenching in a cyclone quench means located in said upstream portion of said transfer line said hot cracked product vapor by injecting into said transfer line upstream of or within said cyclone quench means a quench liquid in an amount and at a temperature sufficient to condense at least a portion of said hot cracked product vapor and produce quenched vapor and condensed liquid; and cyclonically separating said quenched vapor and condensed liquid in said cyclone quench means into a quenched vapor phase and a separate condensed liquid phase, and charging said cyclonically separated quenched vapor phase from said cyclone quench means to said main fractionator via said downstream portion of said transfer line.

In a more limited embodiment, the present invention provides in a fluidized catalytic cracking process wherein a heavy hydrocarbon feed comprising at least 10 wt % hydrocarbons having a boiling point above about 1000 F. is catalytically cracked to cracked products comprising the steps of: catalytically cracking said feed in a riser catalytic cracking zone operating at catalytic cracking conditions including by contacting said feed in a riser reactor with a source of hot regenerated cracking catalyst to produce a riser reactor cracking zone effluent mixture having an effluent temperature above 950 F. and comprising cracked products and spent cracking catalyst containing coke and strippable hydrocarbons; separating said riser reactor effluent mixture into a hot cracked product vapor phase having a temperature above 950 F. and a spent catalyst rich phase; stripping and regenerating said spent catalyst to produce regenerated catalyst which is recycled to crack heavy feed; transferring, via a transfer line having a transfer line diameter and having an upstream portion near said riser cracking zone and a downstream portion near a main fractionator, said hot cracked product vapor to said main fractionator at a transfer line temperature above 950 F. and sufficient to cause at least one of coking and thermal cracking in said transfer line; fractionating in said main fractionator said hot cracked vapor to produce liquid product fractions comprising naphtha, cycle oils and a bottoms fraction boiling above about 750 F.; characterized by quenching said hot cracked product vapor with a quench liquid in a cyclone quench means located in said upstream portion of said transfer line by injecting into said cyclone quench means, or into the transfer line no more than two transfer line diameters upstream of said quench means, quench liquid in an amount and at a temperature sufficient to condense a majority of said cracked product vapor boiling above about 750 F. to produce a two phase mixture comprising quenched vapor and condensed liquid and/or quench liquid comprising at least some droplets having a particle diameter of at least 100 microns and cyclonically separating said two phase mixture in said cyclone quench means to produce a quenched vapor phase, from which at least 98% of said 100 micron and larger droplets have been removed, which is charged to said main fractionator and a separate condensed liquid phase.

In an apparatus embodiment, the present invention provides an apparatus for the fluidized catalytic cracking of a heavy hydrocarbon feed comprising hydrocarbons having a boiling point above about 650 F. to lighter products by contacting said feed with catalytic cracking catalyst comprising: a catalytic cracking riser reactor means having an inlet in a lower portion of a riser connective with a source of said feed and with a source of hot regenerated catalyst and having an outlet at an upper portion of the riser for discharging a cracking zone effluent mixture comprising cracked products and spent cracking catalyst; a separation means within a vessel containing the riser reactor outlet adaptive to separate said cracking zone effluent mixture into a cracked product vapor phase which is removed from said vessel via a vessel vapor outlet and a spent catalyst rich phase which is conveyed to a stripping means; a catalyst stripping means for stripping spent catalyst which is connective with said separations means for admission of spent catalyst and produces a stream of stripped catalyst: a catalyst regeneration means connective with said stripping means for regenerating the stripped catalyst to produce regenerated catalyst and comprising means for recycling regenerated cracking catalyst to the base of the riser reactor; a transfer line, connective with a fractionation means, for transfer of cracked vapor to said fractionation means, having an upstream portion connective with the vessel cracked product vapor outlet and a downstream portion connective with the fractionation means, said transfer line having a line diameter; a quench injection means, located within the upstream portion of the transfer line, comprising means for injection of at least one quench liquid stream into said transfer line in an amount sufficient to form a two phase, vapor liquid mixture; a cyclone separation means in said transfer line and within 0.0 to 2.0 transfer line diameters downstream of said quench injection means, said cyclone separation means adapted to cyclonically separate said two phase mixture into a cracked product vapor phase and a liquid phase and having an inlet connective with said transfer line, a vapor outlet connective with said transfer line, and a separate liquid outlet for separated liquid.

DETAILED DESCRIPTION

Figure 1:
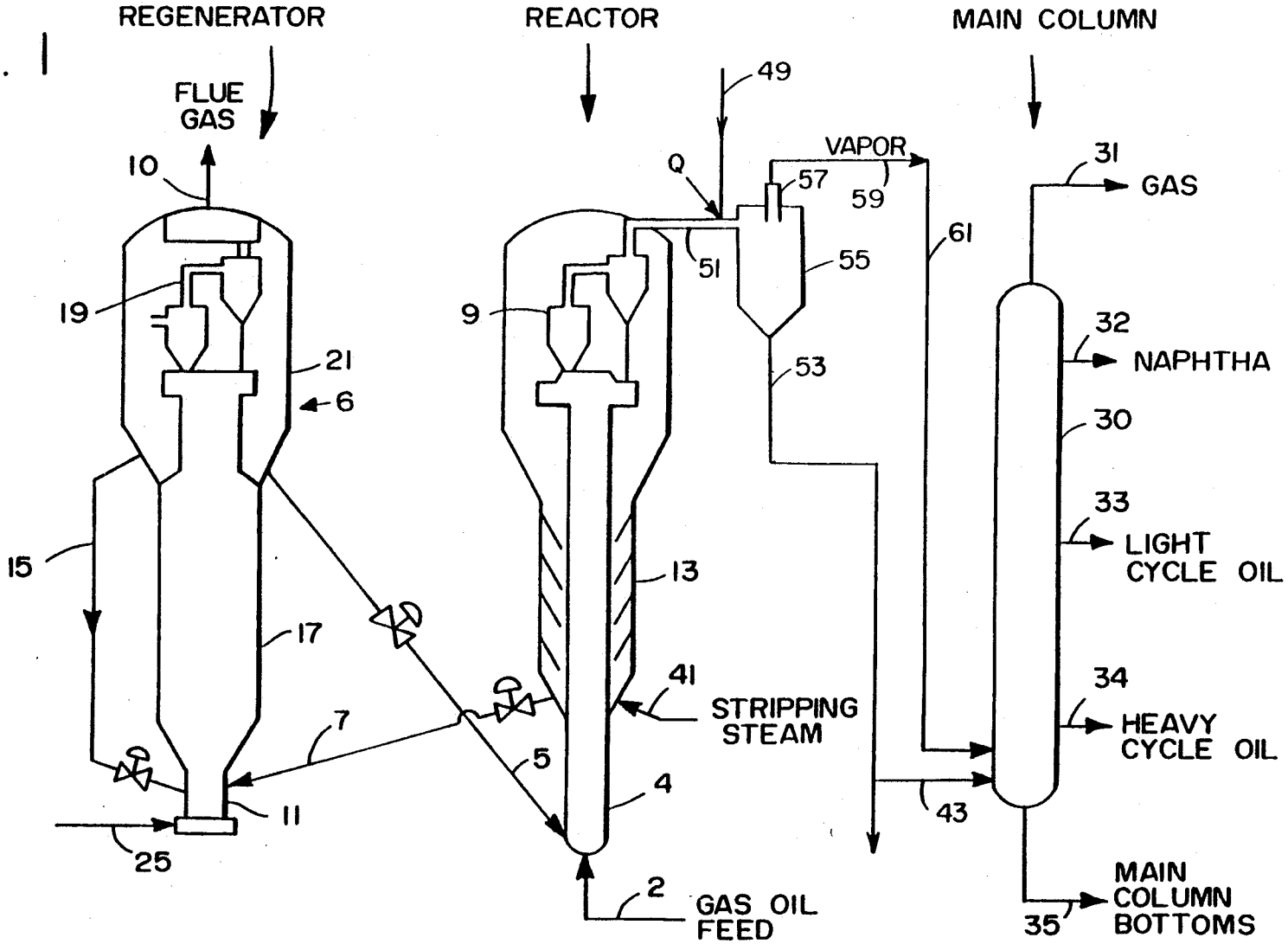
FIG. 1 is a simplified schematic view of an FCC unit with all riser cracking, and a preferred cyclone quencher in the transfer line to the main column.

The present invention can be better understood by reviewing it in conjunction with the conventional way of operating an all riser cracking FCC unit. FIG. 1 illustrates a fluid catalytic cracking system of the prior art, with the cyclone quencher of the invention added downstream of the riser reactor. The FCC reactor and regenerator are conventional, a simplified version of FIG. 1 of U.S. Pat. No. 4,421,636, which is incorporated herein by reference.

A heavy feed, typically a gas oil boiling range material, is charged via line 2 to the lower end of a riser cracking FCC reactor 4. Hot regenerated catalyst is added via conduit 5 to the riser. Preferably, some atomizing steam is added, by means not shown, to the base of the riser, usually with the feed. With heavier feeds, e.g., a resid, 2–10 wt. % steam may be used. A hydrocarbon-catalyst mixture rises as a generally dilute phase through riser 4. Cracked products and coked catalyst are discharged from the riser. Cracked products pass through two stages of cyclone separation shown generally is 9 in the figure.

The riser 4 top temperature is usually cooler than the riser inlet, because the cracking reaction is endothermic. The riser top temperature is usually between about 480 and 615 C. (900 and 1150 F.), and preferably between about 510 and 595 C. (950 and 1050 F.). The riser top temperature is usually controlled by adjusting the catalyst to oil ratio in riser 4 or by varying feed preheat. Cyclones 9 separate most of the catalyst from the cracked products and discharges this catalyst down via diplegs to a stripping zone 13 located in a lower portion of the FCC reactor.

Cracked products are removed from the FCC reactor via transfer line 51 and charged to the base of the main column 30. In some refineries, this column would be called the Syncrude column, because the catalytic cracking process has created a material with a broad boiling range, something like a synthetic crude oil. The main column 30 recovers various product fractions, from a heavy material such as main column bottoms, withdrawn via line 35 to normally gaseous materials, such as the vapor stream removed overhead via line 31 from the top of the column. Intermediate fractions include a heavy cycle oil fraction in line 34, a light cycle oil in line 33, and a heavy naphtha fraction in line 32.

Stripping steam is added via line 41 to recover adsorbed and/or entrained hydrocarbons from catalyst. Stripped catalyst is removed via line 7 and charged to a high efficiency regenerator 6. A relatively short riser-mixer section 11 is used to mix spent catalyst from line 7 with hot, regenerated catalyst from line 15 and combustion air added via line 25. The riser mixer discharges into coke combustor 17. Regenerated catalyst is discharged from an upper portion of the dilute phase transport riser above the coke combustor. Hot regenerated catalyst collects as a dense phase fluidized bed, and some of it is recycled via line 15 to the riser mixer, while some is recycled via line 5 to crack the fresh feed in the riser reactor 4. Several stages of cyclone separation are used to separate flue gas, removed via line 10.

Thermal cracking degrades the cracked product removed via line 51. The average residence time in the transfer line between the FCC reactor outlet and the main column is usually in excess of 10 seconds, although some units operate with a shorter vapor residence times.

The temperature in this line is usually the riser outlet temperature. The combination of time and temperature is enough to cause a significant amount of unselective, and unwanted, thermal cracking upstream of the main column.

There is an additional problem with the prior art design when it is used to crack feeds containing more than 10% non-distillable feeds, or when the feed contains relatively high levels of Conradson Carbon Residue, e.g., exceeding 2, 3, 5 and even 10 wt % CCR. This additional problem is coke formation in the transfer line. It is somewhat related to thermal cracking, but becomes a severe problem only when heavier feedstocks are being cracked. It may be due to carryover of uncracked asphaltenic material, or thermal degradation or polymerization of large aromatic molecules into coke or coke precursors.

Polymerization, or coking in the transfer line need not involve a large fraction of the cracked product to cause a problem with product purity or plugging of the transfer line or the main column. Phrased another way, coking in the unit could shut the unit down, but need not be noticeable in yields. Thermal cracking in the transfer line can cause a significant yield loss, but need not automatically cause coking or plugging of the transfer line. Fortunately both problems are overcome by the process of the present invention.

Cyclone quenching of hot cracked vapor in line 51 is rapidly and effectively achieved in cyclone quenching means 55, which is preferably located as close as possible to the riser reactor outlet. Quench fluid in line 49, preferably a liquid, and most preferably a heavy recycled product fraction, is sprayed via nozzle means 48 into the hot vapor flowing into the cyclone. Quenched vapor is removed via cyclone vapor outlet 57 and charged into transfer line 59 and 61 into the main column. The precipitated liquid fraction, which usually will be a mixture of condensed heavy ends and some quench liquid, collects in the base of the cyclone 55 and is removed via withdrawal line 53. All or a portion of this heavy fraction may be charged to the main column via line 43, preferably at a feed point 1 or more theoretical trays below the point of injection of vapor line 61 to the main column.

Figure 1A:
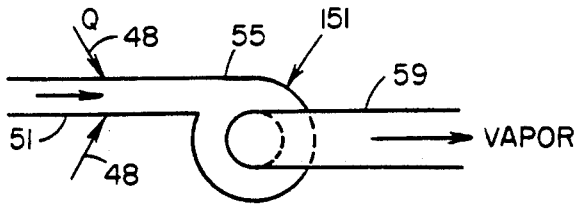
FIG. 1*a* shows a top view of the cyclone quencher.

FIG. 1A provides another view of the cyclone quenching means, and gives a better idea of its operation. In the embodiment shown, with quench injection upstream, but within one pipe diameter of, the cyclone, the quench liquid is injected through one or more nozzles co-currently with the hot cracked vapor and away from the sidewalls of transfer line 51. This can be done safely so long as the nozzles do not cause liquid to impinge on the walls of the transfer line 51. The swirling action of the gas in cyclone 55 drives the liquid to the walls while the vapor is withdrawn from the center.

It is also possible to inject the quench liquid wholly within cyclone 55 if desired. This largely eliminates the possibility of wetting the walls of transfer line 51, but reduces the contact time of quench fluid and hot vapor. Usually it will be preferred to inject quench liquid slightly upstream of cyclone 55. An especially preferred embodiment involves injection both somewhat upstream of e.g.,, within 1 or 2 transfer line diameters upstream of the cyclone quencher and also within or at the throat of the cyclone quencher. Injection of 5–75% of the quench fluid as relatively fine droplets somewhat upstream of the cyclone quencher, and the remainder at the inlet to or within the cyclone quencher, allows significant cooling to occur, without the necessity of adding enough to completely quench the hot vapor. These fine droplets will tend to remain longer with the hot vapor and be more difficult to remove in the cyclone. Addition of larger droplets at the inlet to, or even within, the cyclone quencher can be relied on to complete quenching of hot vapors, and also to improve liquid cyclone efficiency. Large drops are readily rejected by the cyclones, and these large droplets will collide with finer droplets to aid in their collection. Using two stage quench, with fine then coarse droplets, allows lower efficiency and lower pressure drop cyclones to be used while still maintaining effective quench and essentially eliminating liquid carryover into the downstream portion of the transfer line 59.

To improve efficiency further, the droplets injected within the cyclone quencher may be injected countercurrent, to increase their residence time in the quencher and provide somewhat improved heat transfer from vapor to liquid, because of the higher difference in velocities. FIG. 1*a* illustrates a preferred form or countercurrent injection, wherein some of the quench liquid is added via line 151. The flow of quench liquid from injection nozzle means 151 is not quite countercurrent to flow in line 51, but is roughly countercurrent to flow in cyclone quencher 59, i.e., injecting the liquid drops towards the center greatly increases the distance the drops travel in cyclone quencher 59. Their initial velocity carries them somewhat to the center or interior portions of the cyclone, and then they gradually are swept from the center by centripetal force. Wetting the vapor outlet 57 of cyclone quencher 55 is not likely to cause coke formation, because the vapor outlet operates at a much lower temperature than the walls of transfer line 51.

Dual injection, somewhat upstream of, and at or within the cyclone quencher, will be especially beneficial when the upstream quench liquid is completely or readily vaporized. Injection of moderate amounts of a readily vaporizable primary quench fluid, e.g., a naphtha, or light cycle oil, or even water or LPG will create little risk of wall wetting in transfer line 51, but will reduce the temperature enough so that wall wetting, which must occur in cyclone quencher 55, will not occur at high enough temperatures to cause coke to form. Any droplets of primary quench that pass through the cyclone can usually be relied on to vaporize in downstream regions. The secondary quench can function in parallel with, and almost independently of, the primary quench. Changing the amount of atomizing steam and/or pressure drop across the secondary quench nozzle can change the size of the secondary quench droplets, permitting continuous modification of the amount of primary to secondary quench which occurs, and permits great flexibility in permitting use of different quench fluids.

Although only a single cyclone quencher is shown, it is possible to operate with multiple cyclones in series or in parallel. Parallel cyclones permit use of smaller cyclones. Use of multiple, parallel cyclones is common in FCC units. Use of series of cyclone quencher permits use of even lower efficiency cyclones, and or more fractionation, by selective condensation in cyclones, to be achieved. In most refineries, use of a single stage of quenching will be optimum, because quenching and reduction of thermal reactions will pay out very quickly, whereas more elaborate, multiple stage condensing versions will be harder to justify.

Figure 2:
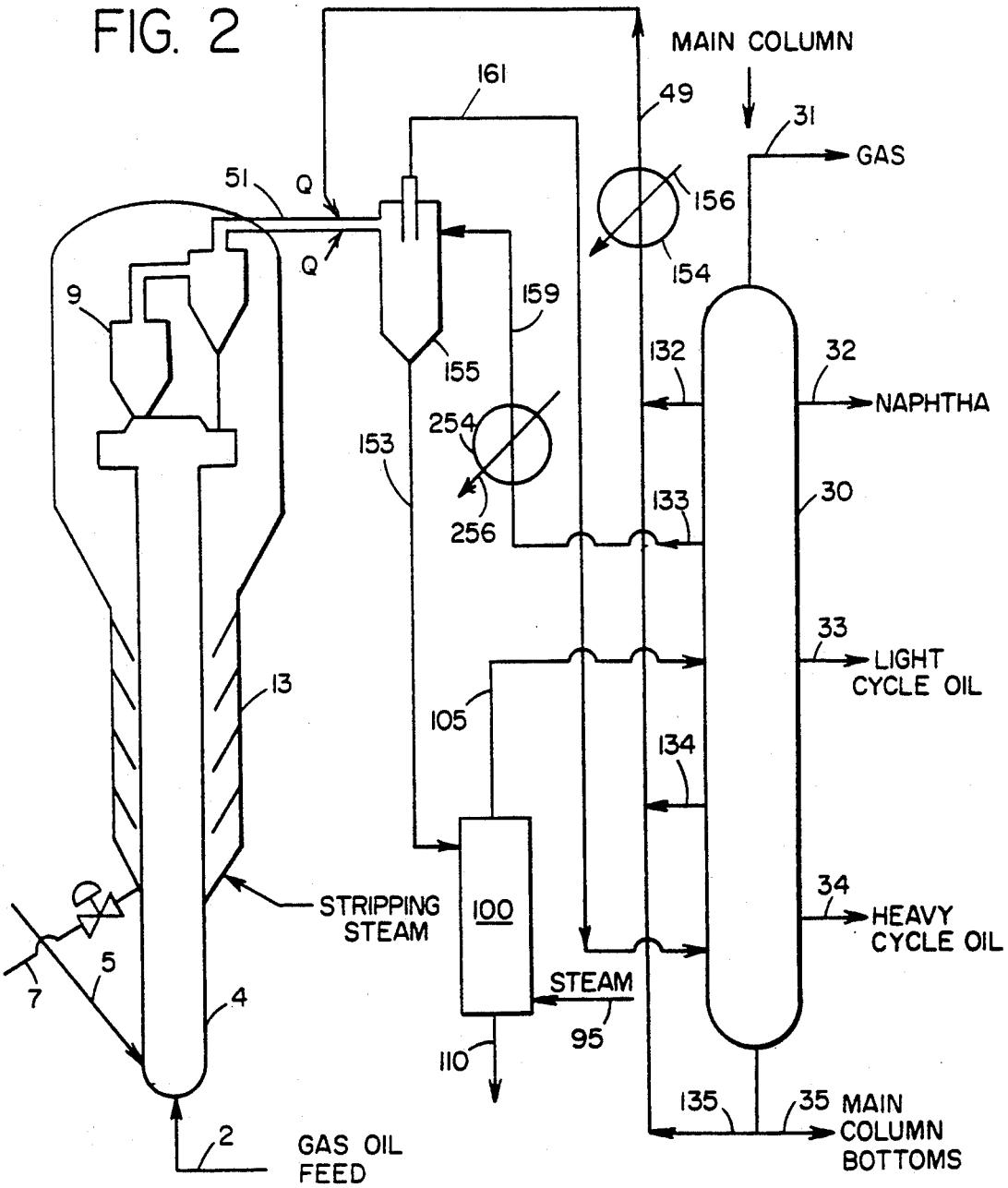
FIG. 2 is a simplified schematic view of an FCC unit of the invention, with a cyclone quench zone in the transfer line from the reactor outlet to the main column, and steam stripping of heavy quench liquid.

FIG. 2 shows a preferred embodiment of the present invention. Most of the elements in FIG. 2 are identical to those in FIG. 1, and like elements, such as main column 30, have like reference numerals in both figures.

As in the FIG. 1 embodiment, a heavy feed, preferably containing more than 10% residual or non-distillable material, is cracked in riser cracker 4. Cracked products are discharged from the riser, pass through two stages of cyclone separation 9 and are discharged via line 51 from the FCC reactor.

The cracked vapors are cooled in several stages in cyclone quench zone 155, which is part of the transfer line 51 just downstream of the FCC reactor section. Hot cracked hydrocarbon vapors in line 51 contact a primary quench liquid charged via line 49 to quench injection nozzle means 51 slightly upstream of cyclone quencher 155. The primary quench liquid is a heavy naphtha fraction withdrawn via line 132 from main column 30, or a fraction which is a very heavy naphtha or light cycle oil withdrawn via line 133. These are light, readily vaporizable, and readily form a fine spray. The primary quench may be cooled, if desired, using cooler 154 and cooling fluid, usually water or low grade stream, in line 156. Other quench liquids, including heavier liquids recycled from the main column, or water may also be used.

Secondary quench liquid is added to cyclone quencher 155 via line 159. This quench liquid can be a main column bottoms stream obtained via line 135, a heavy cycle oil stream from line 134, a light cycle oil from line 133, or a heavy naphtha fraction from line 132. Even lighter quench streams can be used, but are not usually preferred. Thus a normally gaseous liquid stream derived from 31 could be used, but this would create excessive molar volumes. The secondary quench streams may be passed through optional cooler 254. Cooler 254 heat exchanges hot liquid from the main column with a heat exchange fluid, added relatively cool via line 256. Coolers can comprise multiple heat exchangers, in series or in parallel. Coolers 154 and 254 can be used to generate steam for use in power generation or in the refinery steam supply.

The secondary quench liquid is added to the cyclone quencher 155 via nozzle injection means 159. Droplets collect as a whirling pool in the base of cyclone quencher 155 and are removed via line 153. Much conventional equipment, such as pumps, control valves, thermocouples, etc. has been omitted.

Preferably high efficiency spray nozzles are used to distribute liquid. Preferably the liquid is added so that it will rapidly quench and cool the hot reactor vapor. By adding the quench liquid to the cyclone inlet, and distributing it well, it is possible to operate with a generally wetted, and relatively cool walled cyclone. To the extent that hot vapor bypasses quenching liquid, it will not create large, hot, stagnant regions, because of the high vapor flow rates associated with cyclones. The hot vapors are drawn, at high velocity, to the center of the cyclone, while liquid is thrown, by centrifugal force to the walls of the cyclone.

FIG. 2 shows additional preferred embodiments, wherein some useful fractionation is accomplished along with quenching. The heavy condensed liquid removed from the base of the cyclone quench is charged via line 153 to a steam stripper 100. Modest amounts of stripping steam added via line 95 efficiently remove light ends from the condensed liquid. The light ends are conveyed via line 105 to main column 30, or to other fractionation facilities not shown. The heaviest fraction, with a boiling range similar to that of the main column bottoms fraction, can be withdrawn as a heavy product, recycled to the feed to the cat cracker, or recycled to be all or part of the secondary quench. Because most of the heaviest materials are recovered upstream of the main column, and because the feed to the main column is now a vapor stream at its dew point, rather than a severely superheated vapor, the operation of the main column is simplified considerably.

The use of a cyclone quenching arrangement may at first seem likely to increase the pressure drop intermediate the reactor and the main column. While there will always be a pressure drop associated with a cyclone, this need not significantly increase pressure in the reactor. Low or moderate efficiency cyclones work very well, and these operate with relatively low pressure drops. The quenching, and condensation of minor or even major amounts of heavy liquid from the stream can reduce the volume of vapor passing through the transfer line and in the main column. Depending on the amount of quench added, and condensation in the cyclone quencher, the vapor feed to, and the work of the main column can be reduced, thus reducing pressure drop across the main column.

Now that the invention has been briefly reviewed in conjunction with the review of the Figures, a more detailed discussion of feed, catalyst, and equipment will be presented.

FCC FEED

Any conventional FCC feed can be used. The process of the present invention is especially useful for processing difficult charge stocks, those with high levels of CCR material, exceeding 2, 3, 5 and even 10 wt % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650 F.

The most uplift in value of the feed will occur when at least 10 wt %, or 50 wt % or even more of the feed has a boiling point above about 1000 F., or is considered non-distillable.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles, or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Preferred shape selective zeolite additives are those crystalline materials having a Constraint Index of 1–12. ZSM-5 is especially preferred. Details of the Constraint Index test procedures are provided in J. Catalysis 67, 218–222 (1981), U.S. Pat. No. 4,016,218 and in U.S. Pat. No. 4,711,710 (Chen et al), which are all incorporated by reference.

Preferred shape selective crystalline materials are exemplified by ZSM-5, ZSM-11, ZSM-12, ZSM-23, ZSM-35, ZSM-48, ZSM-57 and similar materials.

ZSM-5 is described in U.S. Pat. No. 3,702,886, Reissue U.S. Pat. No. 29,948 and in U.S. Pat. No. 4,061,724 (describing a high silica ZSM-5 as "silicalite").

ZSM-11 is described in U.S. Pat. No. 3,709,979.

ZSM-12 is described in U.S. Pat. No. 3,832,449.

ZSM-23 is described in U.S. Pat. No. 4,076,842.

ZSM-35 is described in U.S. Pat. No. 4,016,245.

ZSM-38 is described in U.S. Pat. No. 4,046,859.

ZSM-48 is described in U.S. Pat. No. 4,350,835.

These patents are incorporated herein by reference.

Zeolites in which some other framework element is present in partial or total substitution of aluminum can be advantageous. Elements which can be substituted for part of all of the framework aluminum are boron, gallium, zirconium, titanium and trivalent metals which are heavier than aluminum. Specific examples of such catalysts include ZSM-5 and zeolite beta containing boron, gallium, zirconium and/or titanium. In lieu of, or in addition to, being incorporated into the zeolite framework, these and other catalytically active elements can also be deposited upon the zeolite by any suitable procedure, e.g., impregnation.

Preferably, relatively high silica shape selective zeolites are used, i.e., with a silica/alumina ratio above 20/1, and more preferably with a ratio of 70/1, 100/1, 500/1 or even higher.

Preferably the shape selective zeolite is placed in the hydrogen form by conventional means, such as exchange with ammonia and subsequent calcination.

Additives for removal of SOx are available from several catalyst suppliers, such as Davison's "R or Katalistiks International, Inc.'s "DeSox." CO combustion additives are available from most FCC catalyst vendors.

The FCC catalyst composition, per se, forms no part of the present invention.

CRACKING REACTOR CONDITIONS

Conventional catalytic cracking conditions may be used, in either a moving bed or fixed bed cracking unit. Fluidized catalytic cracking, especially riser cracking FCC units are preferred. Typical FCC riser cracking reaction conditions include catalyst/oil ratios of 0.5:1 to 15:1 and preferably 3:1 to 8:1, and a catalyst contact time of 0.5–50 seconds, and preferably 1–20 seconds, and riser top temperatures of 900 to about 1050 F.

The process of the present invention tolerates and encourages use of unconventional reactor conditions. Riser top temperatures of 1100 F., 1150 F., 1200 or even higher can be tolerated in the process of the present invention, and are preferred when the feed is heavy, and contains 10% or more of resid. Unusually short riser residence times are possible at such high temperatures, so riser hydrocarbon residence times of 0.1 to 5 seconds may be used., e.g., 0.2 to 2 seconds.

It is preferred, but not essential, to use an atomizing feed mixing nozzle in the base of the riser reactor, such as the MaxiPass available from Bete Fog.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al.

It is preferred, but not essential, to use a hot catalyst stripper. Hot strippers heat spent catalyst by adding some hot, regenerated catalyst to spent catalyst.

The FCC reactor and stripper conditions, per se, can be conventional. In many refineries, the existing reactor and stripper can be left untouched, and the unit modified by adding a cyclone quench zone to the transfer line intermediate the vapor outlet from the reactor section and the main column.

CATALYST REGENERATION

The process and apparatus of the present invention can use conventional TCC or FCC regenerators.

Preferably a high efficiency regenerator, such as is shown in the Figures, is used. The essential elements of a high efficiency regenerator include a coke combustor, a dilute phase transport riser and a second dense bed. Preferably, a riser mixer is used. These regenerators are widely known and used.

The process and apparatus can also use conventional, single dense bed regenerators, or other designs, such as multi-stage regenerators, etc. The regenerator, per se, forms no part of the present invention. In most units, the existing regenerator will be used to practice the present invention.

QUENCH LIQUIDS

Although the process and apparatus of the present invention tolerate quite a range of quench liquids, proper selection of quench fluid can lead to improved results. Proper selection of quench fluid, coupled with some additional equipments, such as the steam stripper shown in FIG. 2, permit changes in operating conditions that could not be tolerated in conventional designs.

Quench liquid can be any fluid which will remove heat from hot, cracked vapor without adversely affecting product properties. Quench fluids can range from the light (water or steam, LNG (liquified natural gas) light hydrocarbons, LPG, propane, butane, natural gasoline liquids, to intermediate boiling range liquids (light naphtha, heavy naphtha, light cycle oil, heavy cycle oil) to heavier liquids including non-vaporizable hydrocarbons (slurry oil, clarified slurry oil, atmospheric resid, vacuum resid). Light liquids are usually clean and easy to work with, but occupy large molar volumes, and in the case of water quench increase sour water production. The heaviest liquids are difficult to work with, but do not increase vapor loading in the main column. The optimum quench fluid will usually be something of intermediate volatility, but can vary greatly from refinery to refinery, and will vary further depending on the configuration of the refinery.

For most refineries, i.e., a typical riser cat cracker, it will usually be best to use a relatively heavy but vaporizable liquid, preferably a a recycled product of the cat cracker. Recycle of a naphtha, light cycle oil, heavy cycle oil, or slurry oil from the FCC or TCC main column. These liquids are always available, are relatively clean, are by definition compatible with cracked product vapor, and will not overload the upper portions of the column or the wet gas compressor. Rather than rely on latent heat of vaporization of these liquids, the heat removal capacity of the quench liquid can be increased by cooling the liquid. Use of a heavy cycle oil quench, cooled by making steam in a heat exchanger, or cooled by preheating some hydrocarbon stream in the refinery, will used which is compatible with the cracked products,

QUENCHING

Conventional spray nozzles may be used to inject quench fluid into the upstream portion of the transfer line, preferably within 0–2 transfer line pipe diameters, or into the throat of the cyclone, or some internal portion of the cyclone, or any combination of these.

It is important not to wet or splash liquid on hot metal surfaces, and for this reason the nozzles should be directed in somewhat from the pipe wall to insure that no wall wetting occurs. Although counter-current flow is better from a droplet residence time in the flowing stream, it will usually be preferred to inject quench liquid co-currently within the transfer line, so that the sporadic large droplets generated by the quench nozzles will not have time or momentum to settle on a hot metal surface.

Conventional nozzles can be used. The problem of atomizing quench liquid is very similar to that of atomizing FCC feed, though generally the quench liquid will be considerably cleaner and lighter than typical FCC feeds. The Bete Fog MaxiPass nozzle can be used, or orifice nozzles with or without spiral tips may also be used. The process and apparatus of the present invention tolerates poor nozzle selection and/or operation well, because if any large droplets are formed these will be subjected to significant shearing during centrifugal separation, discussed in the next section.

Quenching within the cyclone can generally be either co-current or counter-current. Because of the vigorous flow within the cyclone, and flow of hot vapor in, and quench liquid and/or condensate out, the problems of coke formation due to wetting are largely reduced or eliminated. Because a liquid phase will be formed the vigorous quenching contemplated herein, it is beneficial to use an excess of quench liquid so that the walls of the cyclone separator will always have a flowing film of liquid on them.

CYCLONE SEPARATION

The process and apparatus of the present invention can use conventional cyclone separators, which will be very similar in size and shape to cyclone separators used in FCC reactors and regenerators. The process tolerates a low of bypassing, i.e., it is not essential to remove every bit of liquid, all that is essential is removal of enough liquid to prevent two phase or slugging flow in the downstream portion of the transfer line.

Usually it will be adequate to remove 95 or 98 or even 99+% of the droplets having a particle size in excess of 100 microns. This is fairly easy to do, because these droplets have particle sizes and even a particle density somewhat like that of conventional FCC catalyst, and cyclones routinely recover well over 99% of the 50+ micron size particles (although frequently taking several stages of cyclone separation to do it).

The cyclone separators can be designed to achieve practically any desired degree of separation, the only penalty to higher droplets recoveries being increased cost and increased pressure drop across the cyclone. The geometry of a particular installation is important too in selecting a cyclone—if the horizontal distance from the outlet of the cyclone separator to the main column is relatively short then much larger droplets can be tolerated, as compared to the case when fairly large horizontal distances are involved.

Large droplets settle rapidly, while smaller sized droplets have much slower settling velocities. Perry's Chemical Engineers Handbook, Sixth Edition, in FIG. 20–102, reports the terminal gravitational settling velocity for spheres having a specific gravity of 2.0 in air at 25 C. as about 40 cm/sec for 100 micron size particles, and as about 0.6 cm/sec for 10 micron size particles and 0.006 cm/sec for 1 micron size particles. The smaller particles are very difficult to remove, but these have such a low settling velocity that they are unlikely to settle rapidly enough in the relatively short horizontal distances involved, usually less than about 100 horizontal feet from the cyclone separator to the main column.

It may be beneficial to provide a dam, with a drain, or tilted lines downstream of the cyclone separator as an additional precautionary method.

ROUGH-CUT FRACTIONATION

It is possible to achieve some fractionation of heavy cracked products from lighter hydrocarbons in the cyclone quenching zone. The cyclone quench zone will do a poor job of fractionation, i.e., a single stage of quenching will at best equal a single theoretical tray of a fractionator, but even a single stage of fractionation will accomplish some useful work, and more importantly recover a significant amount of product, albeit having a broad boiling range. This can be exploited in several ways to unload or debottlekneck the main column. Merely bringing in the hot vapor to the main column as a vapor, at its dew point, ensures that fractionation, rather than cooling of superheated vapor, occurs in the main column. In some columns, especially older ones with bubble cap designs, the flow patterns are so poor that coking can occur inside the column. For this reason many moving bed cracking units quench superheated vapor at the inlet to the main column. Cyclone quenching achieves this same benefit, but does more. Cyclone quenching eliminates thermal reactions in the transfer line to the main column, and cyclone quenching can also help de-bottleneck the main column.

De-bottlenecking of the main column can be achieved if the heavy liquid phase recovered from the cyclone quencher, containing a spectrum of relatively heavy products, is fractionated or steam stripped to produce desired product fractions outside of the main column. Design of this fractionator or stripper is fairly straightforward, because there are essentially no light ends in this liquid, and little material boiling in the naphtha and lighter range. This is because the relative volatility differences are so great between light naphtha and, e.g., heavy cycle oil and similar heavy hydrocarbons that remain in the heavy liquid drained from the cyclone quencher that one theoretical stage of fractionation or separation can effect a good removal of naphtha and lighter hydrocarbons from heavy cycle oil and heavier hydrocarbons.

This heavy quench liquid stream can be used as a fuel, but maximum uplift in value will usually be achieved when it is fractionated in a separate fractionator or even simply charged to the main fractionator.

STEAM STRIPPING OF CYCLONE LIQUID

A low cost, but effective way to recover more valuable liquid fractions from the condensed liquid will be to charge the cyclone quench liquid to a separate steam stripper, as shown in FIG. 2. Low grade refinery stream is always available in a refinery, and the stripping action, or pseudo vacuum, formed by injection of steam in the cyclone quench liquid will rapidly and effectively remove the more valuable light and heavy cycle oil fractions from the heaviest liquid fraction.

The steam stripping, or conventional reboiled fractionation of liquid from the cyclone quencher can be accomplished using conventional equipment. Usually packed trays, with 5-25 theoretical trays will be used, because of their efficiency and low pressure drop. Bubble or sieve trays can also be used. The auxiliary fractionator may float on the pressure of the main column, with the vapor fraction from the auxiliary fractionator being charged to the main column. Preferably the vapor from the auxiliary fractionator is added to the main column at an elevation at least 1 theoretical tray above the point of introduction of the vapor from the cyclone quencher. This is because the auxiliary fractionator has accomplished some work in separating lighter from heavier components, and this work would to some extent be wasted if the auxiliary fractionator vapor were merely added to the main column with the quench vapor. The optimum feed point location for the auxiliary fractionator vapor stream to the main column can easily be determined by those skilled in the arts. The composition of key components in the auxiliary fractionator overhead vapor can be determined by experiment, or preferably using a computer program which simulates column operation. A similar computer program, or experimentation, can determine where in the main column the composition of these two key components is about the same. In this way the work accomplished by the auxiliary fractionator can be preserved, even though some use is made of the main column for final polishing of the product, and for piping to get product fractions to storage.

COMPARISON OF ESTIMATED YIELDS

The benefits of practicing the present invention can most easily be seen by comparing the yields obtainable in a conventional, prior art FCC unit versus an estimate of the yields obtainable in the same unit by adding a cyclone quench zone to the transfer line, as close as possible to the riser reactor outlet, cyclones, etc.

ESTIMATE 1—PRIOR ART

The prior art unit estimate is based on yields obtainable in a conventional FCC unit operating with a riser reactor, a high efficiency regenerator, and a conventional catalyst stripper.

The reactor conditions included:

Riser Top Temperature = 1000 F.

Riser Top pressure 32 psig

Cat:Oil Weight Ratio 6.5:1

The reactor discharged into a plenum having a volume of 2,154 cubic feet. The transfer line had a volume of 3,291 cubic feet, and was about 225 feet of 54" OD line.

The feed a specific gravity of 0.9075.

Under these conditions, the unit achieved a 76.11 vol % conversion of feed.

The following yield estimate is presented in three parts. The first or base case is with no changes. The second eliminates the plenum, but does not quench. The third (invention) eliminates the plenum and quenches the reactor effluent vapor within 10 or 20 feet of the reactor outlet, to a temperature of 700-800 F. using a heavy quench liquid such as LCO, HCO or Main Column Bottoms injected at about 520 F. through an in-line peripheral nozzle arrangement.

TRANSFER LINE QUENCHING STUDY

| CASE: | BASE | NO PLENUM | QUENCH |
|---|---|---|---|
| Conversion, Vol. % = | 76.11 | −0.10 | −0.23 |
| Gasoline Yield, Vol % | 58.12 | 0.16 | 0.39 |
| Gasoline Octane, RONCL | | −.09 | −0.31 |
| C2 and lighter wt % | 4.22 | −0.10 | −0.08 |
| C3 + C4 olefins, vol % | 15.06 | −0.15 | −0.37 |
| iC4 vol % | 5.32 | 0.01 | 0.02 |
| Light Fuel Oil | 18.27 | 0.16 | 0.39 |
| Heavy fuel Oil | 5.62 | −0.06 | −0.16 |
| G + D vol % | 76.39 | 0.32 | 0.80 |
| Coke (weight %) | 5.12 | 0 | 0 |

This shows a decrease in thermal cracking. The ERT, or equivalent reaction time at 800 F. in the transfer line has been significantly reduced. This reduction in thermal cracking increases yields of valuable liquid product, and improves product quality. There is a slight decrease in gasoline octane number because thermal cracking produces olefinic gasoline which has a good octane number. Thermal cracking also reduces yields of gasoline.

The process of the invention (eliminating the reactor plenum, and quenching in the transfer line) increases G+D yields, or gasoline plus distillate yields, by about 0.80 vol %. In the commercially sized unit which was the basis for this study, processing 96.5 thousand barrels per day of feed, the practice of the present invention results in an increase of 772 barrels of gasoline and distillate product.

The process and apparatus of the present invention will allow higher riser top temperatures to be used, and higher top temperatures lead to several other benefits which will occur in practice, but are not reflected in the above yield estimates.

Vaporization of all feeds, and especially of resids, is favored by higher reactor temperatures. Much of the base of the riser is devoted to vaporizing the feed, and operating with higher riser temperatures allows more of the riser to be used for vapor phase cracking, rather than vaporization of liquid.

Higher riser top temperatures allow more heat to be removed from the FCC unit with the cracked products. Less heat must be removed in the regenerator. This helps to keep the unit in heat balance. This heat is eventually recovered in downstream fractionators or heat exchangers.

Catalyst stripping will be slightly better at higher temperatures, so higher riser top temperatures will improve somewhat the stripping operation.

Addition of sufficient cyclone quench liquid to condense some of the cracked heavy product, preferably at least 5 or 10 wt % of the slurry oil boiling range material, ensure complete quenching. Condensation of significant amounts of the vacuum gas oil boiling range material will usually be preferred both from the standpoint of completely eliminating thermal reactions in the transfer line, and in the quench liquid, and from a viewpoint of unloading the transfer line and the main column.

It may be beneficial in some units to use a cyclone quench zone lined with a relatively non-sticking material, such as a ceramic coating, or Teflon, or some other material which does not provide coke deposits a place to grow. Providing such a coating immediately upstream of the cyclone quenching line may also be beneficial, and provided added security against coke growth due to inadvertent wetting of the wall of the transfer line 51.

Cyclone quenching provides efficient contacting and efficient separation at the same time. Centrifugal forces enhance droplet separation several hundred-fold over separations achievable through gravity alone. The process of the present invention allows all the benefits of in line quench to be achieved, but without creating the problems of two phase flow downstream of the quench point. Cyclone quenching will generally provide more efficient quenching, and avoid hotspots, which can occur when more conventional approaches to quenching are taken.

I claim:

1. A fluidized catalytic cracking process wherein a heavy hydrocarbon feed comprising hydrocarbons having a boiling point above about 650 F. is catalytically cracked to cracked products comprising the steps of:

a. catalytically cracking said feed in a catalytic cracking zone operating at catalytic cracking conditions including a catalyst/oil ratio of about 0.5:1 to 15:1, a catalyst contact time of about 0.5 to 50 seconds, and a riser top temperature of about 900 F. to about 1200 F. by contacting said feed with a source of hot regenerated cracking catalyst to produce a cracking zone effluent mixture having an effluent temperature of 900 to 1150 F. and comprising cracked products and spent cracking catalyst containing coke and strippable hydrocarbons;

b. separating said cracking zone effluent mixture into a hot cracked product vapor phase having a temperature above 900 F. and a spent catalyst rich phase;

c. stripping and regenerating said spent catalyst to produce regenerated catalyst which is recycled to crack heavy feed;

d. transferring said hot cracked product vapor from said catalytic cracking zone to a main fractionator transfer line, having an upstream portion which is nearer the cracking reactor and a downstream portion which is nearer the main fractionator, operating at a transfer line temperature above 900 F. and sufficient to cause at least one of thermal cracking of said cracked vapor and coke formation from said cracked vapor product in said transfer line;

e. quenching in a cyclone quench means located in said upstream portion of said transfer line said hot cracked product vapor by injecting into said transfer line upstream of or within said cyclone quench means a quench liquid in an amount and at a temperature sufficient to condense at least a portion of said hot cracked product vapor and produce quenched vapor and condensed liquid; and f. cyclonically separating said quenched vapor and condensed liquid in said cyclone quench means into a quenched vapor phase and a separate condensed liquid phase, and charging said cyclonically separated quenched vapor phase from said cyclone quench means to said main fractionator via said downstream portion of said transfer line.

2. The process of claim 1 wherein the quench liquid is a product fraction recycled from said main fractionator.

3. The process of claim 1 wherein the quench liquid is sprayed into the inlet to the cyclone quenching means via at least one spray nozzle.

4. The process of claim 1 wherein the quench liquid is an aromatic hydrocarbon stream derived from the main column and selected from the group of naphtha, light cycle oil, heavy cycle oil, main column bottoms, and mixtures thereof.

5. The process of claim 1 wherein the quench liquid is cooled by heat exchange prior to injection into the cyclone quench means.

6. The process of claim 1 wherein the hot cracked product vapor has a temperature of at least 1000 F., the quench liquid is selected from the group of light cycle oil, heavy cycle oil and main column bottoms, and said quench liquid is injected at a temperature below 700 F. to produce a quenched vapor having a temperature of about 700 to 900 F.

7. The process of claim 1 wherein the condensed liquid recovered from said cyclone quenching means is charged to a fractionation means other than the main fractionator.

8. The process of claim 7 wherein the condensed liquid is charged to a steam stripper and stripped with steam at to produce a steam stripped liquid which is recovered as a product and a vapor phase which is charged to said main fractionator.

9. The process of claim 1 wherein said condensed liquid recovered from said cyclone quenching means is charged to said main fractionator at a feed point location, and said quenched vapor is charged to said main fractionator at a feed point location which is above said feed point location of said condense liquid.

10. A fluidized catalytic cracking process wherein a heavy hydrocarbon feed comprising at least 10 wt % hydrocarbons having a boiling point above about 1000 F. is catalytically cracked to cracked products comprising the steps of:

a. catalytically cracking said feed i a riser catalytic cracking zone operating at catalytic cracking conditions including a catalyst/oil ratio of about 0.5:1 to 15:1, a catalyst contact time of about 0.5 to 50 seconds, and a riser top temperature of about 900 F. to 1200 F. by contacting said feed in a riser reactor with a source of hot regenerated cracking catalyst to produce a riser reactor cracking zone effluent mixture having an effluent temperature above 950 F. and comprising cracked products and spent cracking catalyst containing coke and strippable hydrocarbons;

b. separating said riser reactor effluent mixture into a hot cracked product vapor phase having a temperature above 950 F. and a spent catalyst rich phase;

c. stripping and regenerating said spent catalyst to produce regenerated catalyst which is recycled to crack heavy feed;

d. transferring, via a transfer line having an upstream portion near said riser cracking zone and a downstream portion near a main fractionator, said hot cracked product vapor to said main fractionator at a transfer line temperature above 950 F. and sufficient to cause at least one of coking and thermal cracking in said transfer line:

e. fractionating in said main fractionator said hot cracked vapor to produce liquid product fractions comprising naphtha, cycle oils and a bottoms fraction boiling above about 750 F.;

f. quenching said hot cracked product vapor with a quench liquid in a cyclone quench means located in said upstream portion of said transfer line by injecting into said cyclone quench means, or into the transfer line upstream of said quench means, quench liquid in an amount and at a temperature sufficient to condense a majority of said cracked product vapor boiling above about 750 F. to produce a two phase mixture comprising quenched vapor and condensed liquid and/or quench liquid comprising at least some droplets having a particle diameter of at least 100 microns and g. cyclonically separating said two phase mixture in said cyclone quench means to produce a quenched vapor phase, from which at least 98% of said 100 micron and larger droplets have been removed, which is charged to said main fractionator and a separate condensed liquid phase.

11. The process of claim 10 wherein the quench is performed in two stages, a first stage of quenching within one to two transfer line pipe diameters upstream of said cyclonic quenching means with a primary quench liquid an a second stage of quenching at the inlet of or within said cyclonic quenching means, with a secondary quench liquid.

12. The process of claim 11 wherein the secondary quench liquid is a hydrocarbon stream derived form the main column and selected from the group consisting of a main column bottoms stream, a heavy cycle oil stream, a light cycle oil, and a heavy naphtha fraction.

13. The process of claim 10 wherein the primary quench liquid is an aromatic hydrocarbon stream derived from the main column and selected from the group of a naphtha fraction, a light cycle oil, a heavy cycle oil, a main column bottoms fraction, and mixtures thereof.

14. The process of claim 10 wherein the quench liquid is cooled by heat exchange prior to injection into the cyclone quench means.

15. The process of claim 10 wherein the hot cracked product, vapor has a temperature of at least 1000 F., at least a portion of the quench zone liquid is selected from the group of light cycle oil, heavy cycle oil and main column bottoms, and sufficient quench liquid is injected at a temperature of about 200–700 F. to produce a quenched vapor product temperature of about 700–900 F.

16. The process of claim 10 wherein the condensed liquid is charged from said cyclone separation means to a steam stripper, stripped with steam to produce a vapor product which is charged to said main fractionator and a liquid product.

17. An apparatus for the fluidized catalytic cracking of a heavy hydrocarbon feed comprising hydrocarbons having a boiling point above about 650 F. to lighter products by contacting said feed with catalytic cracking catalyst comprising:

a. a catalytic cracking riser reactor means having an inlet in a lower portion of a riser connective with a source of said feed and with a source of hot regenerated catalyst and having an outlet at an upper portion of the riser for discharging a cracking zone effluent mixture comprising cracked products and spent cracking catalyst;

b. a separation means within a vessel containing the riser reactor outlet adaptive to separate said cracking zone effluent mixture into a cracked product vapor phase which is removed from said vessel via a vessel vapor outlet and a spent catalyst rich phase which is conveyed to a stripping means;

c. a catalyst stripping means for stripping spent catalyst which is connective with said separations means for admission of spent catalyst and produces a stream of stripped catalyst:

d. a catalyst regeneration means connective with said stripping means for regenerating the stripped catalyst to produce regenerated catalyst and comprising means for recycling regenerated cracking catalyst to the base of the riser reactor;

e. a transfer line, connective with a fractionation means, for transfer of cracked vapor to said fractionation means, having an upstream portion connective with the vessel cracked product vapor outlet and a downstream portion connective with the fractionation means, said transfer line having a line diameter;

f. a quench injection means, located within about 20 feet of the vessel cracked product vapor outlet comprising means for injection of at least one quench liquid stream into said transfer line in an amount sufficient to form a two phase, vapor liquid mixture;

g. a cyclone separation means in said transfer line downstream of said quench injection means, said cyclone separation means adapted to cyclonically separate said two phase mixture into a cracked product vapor phase and a liquid phase and having an inlet connective with said transfer line, a vapor outlet connective with said transfer line, and a separate liquid outlet for separated liquid.

18. The apparatus of claim 17 further comprising a liquid recycle means adapted to recycle a liquid product fraction from said fractionation means to said quench means.

19. The apparatus of claim 17 further comprising a steam stripping means having a liquid inlet connective with said cyclone separation means liquid outlet, a stripping gas inlet, a vapor outlet connective with said fractionation means, and a stripped liquid outlet.

* * * * *

UNITED STATES PATENT AND TRADEMARK OFFICE

CERTIFICATE OF CORRECTION

PATENT NO. : 5,185,077

DATED : February 9, 1993

INVENTOR(S) : Hartley Owen

It is certified that error appears in the above-indentified patent and that said Letters Patent is hereby corrected as shown below:

Column 20, line 62 (Claim 8), after "steam" (first occurrence) delete "at".

Column 21, line 8 (Claim 10), "i" should read --in--.

Column 21, line 26 (Claim 10), after "having" insert --a transfer line diameter and having--.

Column 21, line 41 (Claim 10), after "line" insert --no more than two transfer line diameters--.

Column 22, line 53 (Claim 17), after "means" delete "said transfer line having a line diameter".

Signed and Sealed this

Eighth Day of February, 1994

Bruce Lehman

*Attest:*

BRUCE LEHMAN

*Attesting Officer*

*Commissioner of Patents and Trademarks*